US006902231B1

(12) United States Patent
Tseng

(10) Patent No.: US 6,902,231 B1
(45) Date of Patent: Jun. 7, 2005

(54) COLLAPSIBLE CHAIR

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/858,125

(22) Filed: Jun. 1, 2004

(51) Int. Cl.[7] ..... A47C 4/00
(52) U.S. Cl. ..... 297/27; 28/39
(58) Field of Search ..... 297/27, 16.2, 19, 297/28, 30, 35, 39, 68

(56) References Cited

U.S. PATENT DOCUMENTS 2,195,091 A * 3/1940 Lorenz et al. ..... 297/27
4,072,341 A * 2/1978 Kurz ..... 297/27
5,464,270 A * 11/1995 Chang ..... 297/81
5,570,926 A * 11/1996 Papiernik et al. ..... 297/39
6,502,899 B2 * 1/2003 Tseng ..... 297/28
6,517,152 B1 * 2/2003 Chen ..... 297/38
6,692,068 B1 * 2/2004 Tang ..... 297/16.2

* cited by examiner

*Primary Examiner*—Laurie K. Cranmer
(74) *Attorney, Agent, or Firm*—Ladas & Parry LLP

(57) ABSTRACT

A collapsible chair includes front and rear leg members interconnected pivotally at upper end areas. A connector is connected pivotally to the rear leg member, and an extension limiter is connected pivotally to the connector at one end and to the front leg member at its other end. Also included are a backrest frame connected pivotally to the connector, and a pair of armrests. A coupling device is used to couple the leg members to at least one of the armrests. The coupling device includes a fastener-engaging member secured to one of the armrests and formed with a slot, an inner fastener, and an outer fastener engaging the inner fastener to arrest movement of the leg members relative to the slot. A seat member is connected pivotally to the connector, and a legrest frame is connected pivotally to the armrests and the seat member.

1 Claim, 6 Drawing Sheets

COLLAPSIBLE CHAIR

BACKGROUND OF THE INVENTION

1. Field of the Invention

The present invention relates to a collapsible chair, more particularly to a collapsible chair with a compact folded configuration and that is able to be reclined to varying degrees and in such a manner that a backrest frame and a legrest frame are simultaneously adjusted in a single-step operation.

2. Description of the Related Art

U.S. Pat. No. 5,570,926 discloses an easychair including a frame forming the back of the chair, two side members forming the seat, and armrests that are spaced apart. The side members and the armrests are connected to the frame. A U-shaped frame serves as a legrest, and the base of the chair is formed using a front leg unit and a rear leg unit. Each armrest includes a slide rod, and ends of the front leg unit are slidably mounted to the slide rod via a forked yoke and an eccentric, which serve as a locking mechanism.

One drawback of the aforesaid easychair is that the locking mechanism is inconvenient to operate. In addition, the locking mechanism tends to wear out over time since friction is used to realize the locking action. Wearing of the locking mechanism may result in its inability to lock onto the slide rod. Furthermore, the friction-locking action may scratch or otherwise damage the slide rod.

Another drawback of the aforesaid easy chair is that the slidable connection between the rear leg unit and the side members does not result in a compact configuration upon folding.

SUMMARY OF THE INVENTION

The object of this invention is to provide a collapsible chair that is stable in its folding and reclining operations, and that is simple in structure.

According to this invention, a collapsible chair comprises a leg frame unit having an upper frame end. The leg frame unit includes a front leg member having an upper end portion, a rear leg member having an upper end portion connected pivotally to the upper end portion of the front leg member, a connector, and an extension limiter. The connector has a first end connected pivotally to the rear leg member, and a second end. The extension limiter has a rear portion connected pivotally to the second end of the connector, and a front portion connected pivotally to the front leg member.

The chair further comprises a backrest frame having a lower back portion connected pivotally to the second end of the connector, and a pair of armrests. Each of the armrests has a rear end connected pivotally to the backrest frame, a front end opposite to the rear end in a front-to-rear direction, and an intermediate section between the rear and front ends.

At least one coupling device couples the upper frame end of the leg frame unit to the intermediate section of one of the armrests. The coupling device includes a fastener-engaging member secured to the intermediate section of said one of the armrests and formed with a slot that extends in the front-to-rear direction, and an inner fastener having a head and an externally threaded section that extends from the head and through the upper frame end of the leg frame unit and the slot. The coupling device further includes an outer fastener engaging threadedly the externally threaded section. The coupling device arrests movement of the upper frame end of the leg frame assembly relative to the slot when the outer fastener is tightened on the externally threaded section of the inner fastener.

A seat member has a front portion and a rear portion, the rear portion being connected pivotally to the second end of the connector. A legrest frame has an upper portion connected pivotally to the front ends of the armrests. The legrest frame is further connected pivotally to the front portion of the seat member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
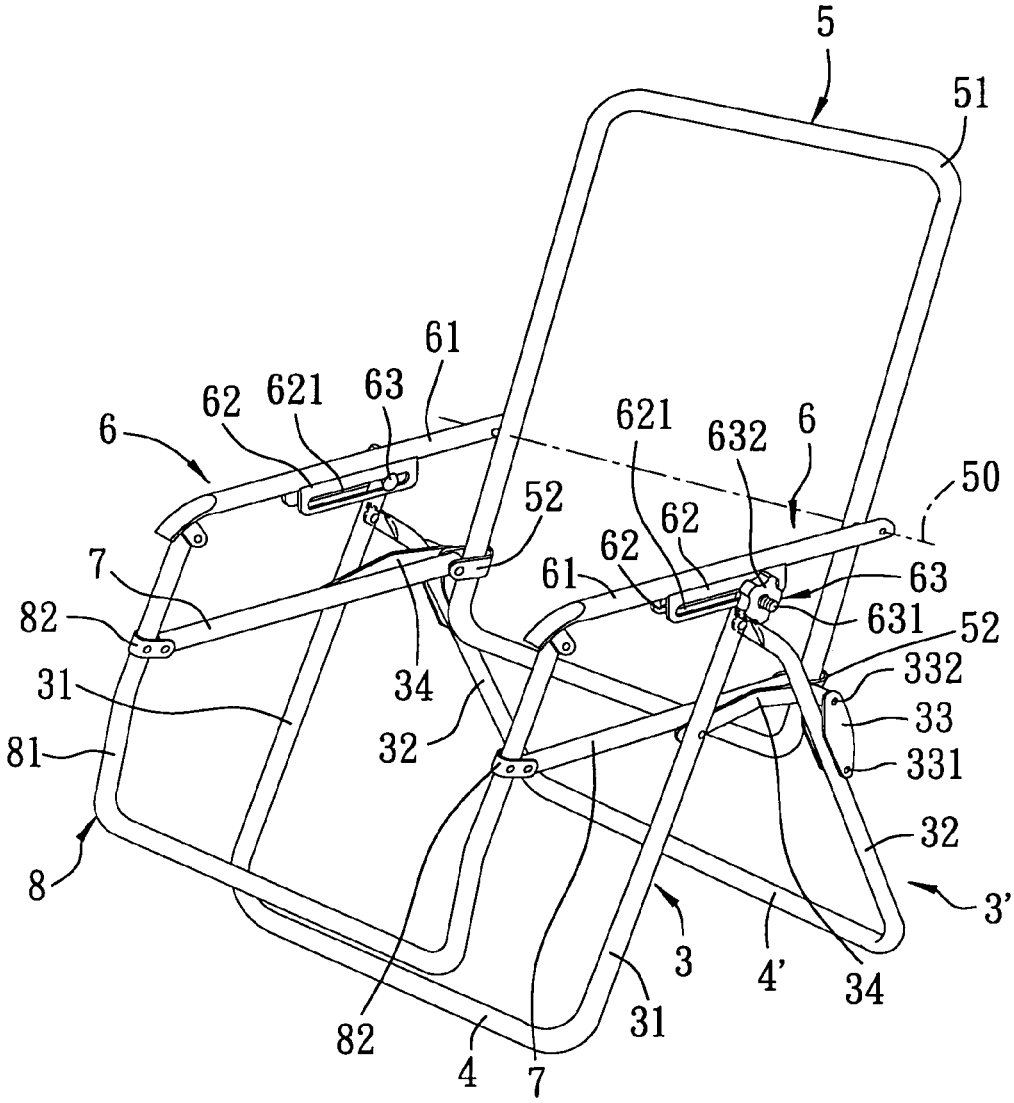
FIG. 1 is an assembled perspective view of a collapsible chair according to a preferred embodiment of the present invention, in which the collapsible chair is shown in a sitting upright position.
Figure 2:
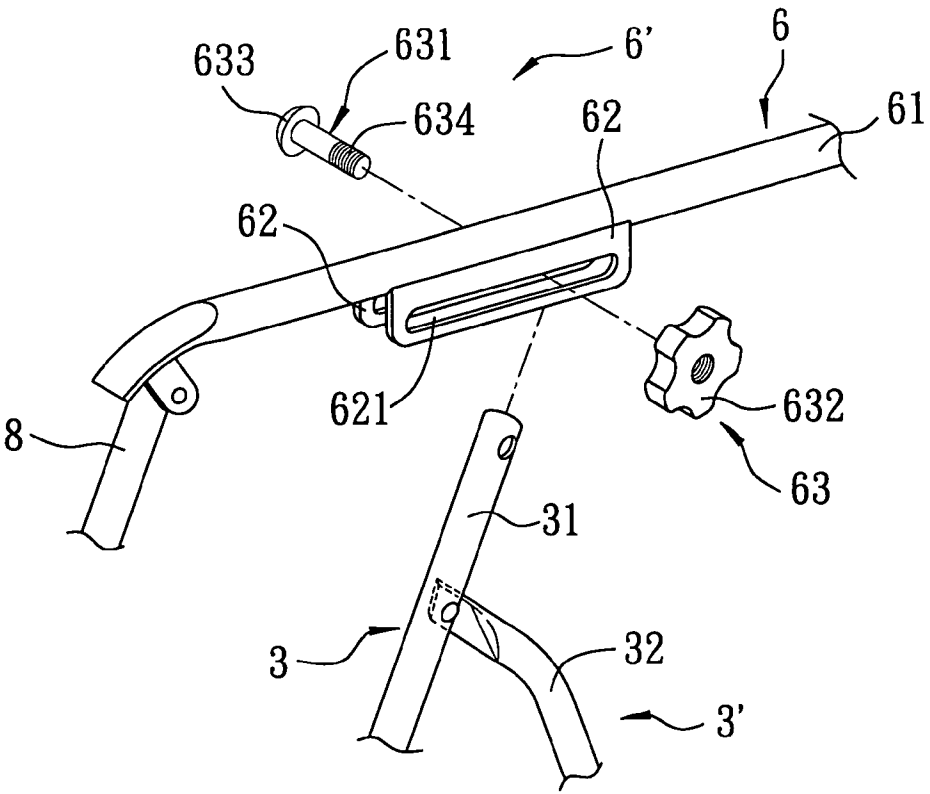
FIG. 2 is a fragmentary partly exploded perspective view illustrating an armrest assembly of the collapsible chair of FIG. 1.
Figure 3:
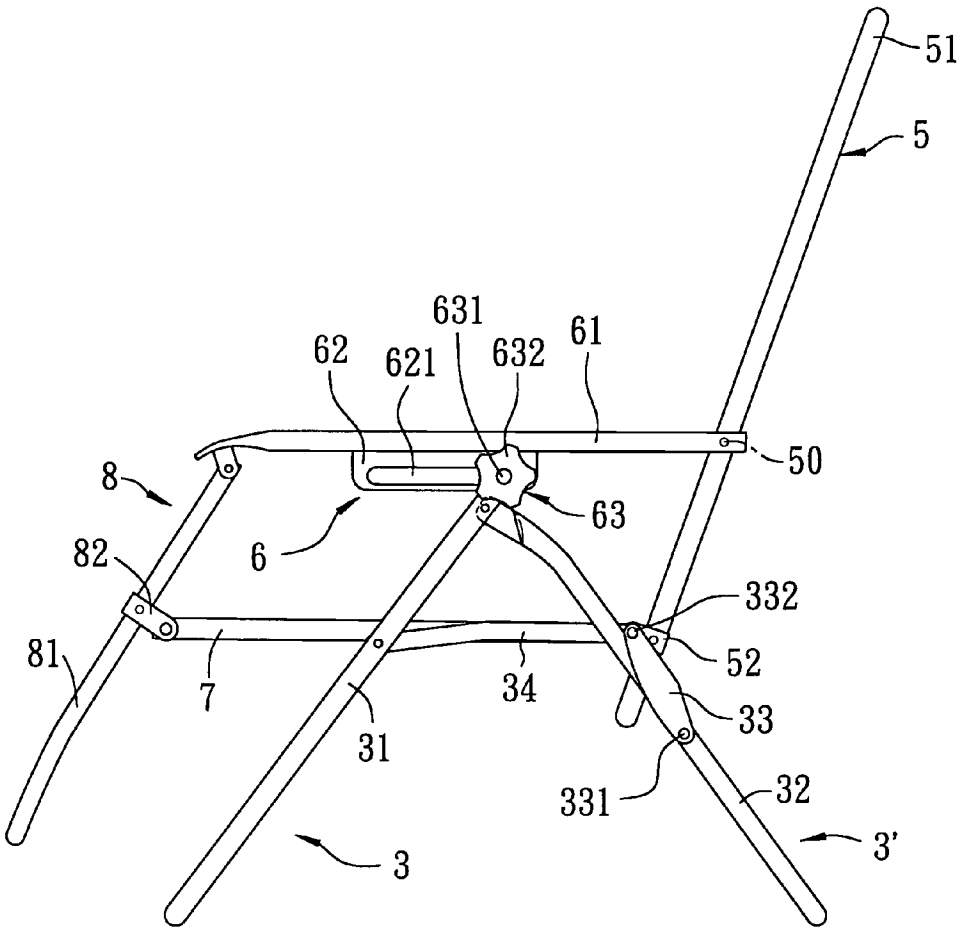
FIG. 3 is a schematic view of the collapsible chair of FIG. 1.

Referring to FIGS. 1, 2, and 3, a collapsible chair according to a preferred embodiment of the present invention includes a leg frame unit having a front leg member 3 and a rear leg member 3'. The front and rear leg members 3, 3' stably support the collapsible chair on the ground. In the preferred embodiment, the front leg member 3 includes a pair of spaced-apart forward legs 31, and the rear leg member 3' includes a pair of spaced-apart rearward legs 32. In the preferred embodiment, a forward base support 4 integrally interconnects the two forward legs 31, and a rearward base support 4' integrally interconnects the two rearward legs 32. Therefore, the base supports 4, 4' rest on the ground such that the front and rear leg members 3, 3' are able to support the collapsible chair. Also, with this configuration, the front and rear leg members 3, 3' are formed as U-shaped frames.

A backrest frame 5 is positioned approximately in the area of the rearward legs 32 of the rear leg member 3', with a lower back portion of the backrest frame 5 positioned between the rearward legs 32 when the collapsible chair is in the sitting upright position of FIGS. 1 and 3. Two armrest assemblies 6 have rear ends pivotally connected to the backrest frame 5, and intermediate sections adjustably connected to the leg frame unit. A legrest frame 8 has an upper portion pivotally connected to front ends of the armrest assemblies 6.

The collapsible chair also includes a seat member having seat supports 7 that extend in a front-to-rear direction between the legrest frame 8 and the backrest frame 5 at a predetermined position under the armrest assemblies 6. The seat supports 7 have front and rear portions pivotally and respectively connected to the legrest frame 8 and the backrest frame 5.

An upper end portion of each of the forward legs 31 is pivotally connected to an upper end portion of a corresponding one of the rearward legs 32. In the preferred embodiment, the rearward legs 32 are pivotally connected to the corresponding forward legs 31 at a predetermined distance from extreme ends of the forward legs 31.

Furthermore, an extension limiter 34 and a connector 33 are used to interconnect each of the forward legs 31 to its corresponding rearward leg 32. In particular, and using one of the forward legs 31 and its corresponding rearward leg 32 as an example, one of the extension limiters 34 has a front portion pivotally connected to the forward leg 31, a first end 331 of the connector 33 is pivotally connected to the rearward leg 32, and a rear portion of the extension limiter 34 and a second end 332 of the connector 33 are pivotally interconnected.

The extension limiters 34 and the connectors 33 operate such that when the forward legs 31 and the rearward legs 32 are spread apart about the points where they are interconnected as described above, the forward legs 31 and the rearward legs 32 are limited in their spreading degree and are prevented from further movement after a predetermined point. This predetermined degree of spread between the forward legs 31 and the rearward legs 32 is determined by the lengths of the extension limiter 34 and the connector 33. The extension limiters 34 and the connectors 33 also aid in the folding of the collapsible chair. This will be described in greater detail hereinafter.

The backrest frame 5 includes a backrest frame body 51. The connection of the seat supports 7 to the backrest frame 5 is realized through backrest clasps 52. In the preferred embodiment, the backrest clasps 52 are substantially U-shaped and are fixed to the backrest frame body 51 at a location below a pivot axis 50 of the armrest assemblies 6. The backrest clasps 52 embrace the backrest frame body 51, and ends of the backrest clasps 52 are pivotally connected to the seat supports 7.

Each of the backrest clasps 52 is also connected to the second end 332 of the corresponding connector 33. Therefore, the rearward legs 32 of the rear leg member 3' are connected to the seat supports 7 and to the backrest frame body 51 of the backrest frame 5.

Each of the armrest assemblies 6 includes an armrest 61. The armrest 61 has a rear end pivotally connected to the backrest frame 5, a front end pivotally connected to the legrest frame 8, and an intermediate section between the front and rear ends and adjustably connected to the leg frame unit. With particular reference to FIG. 2, each of the armrest assemblies 6 also includes a coupling device 6' having two fastener-engaging members 62, and a position-adjusting fastener 63. The fastener-engaging members 62 extend downwardly from the armrest 61 and toward the corresponding seat support 7. The fastener-engaging members 62 are spaced apart from each other and extend in the front-to-rear direction. Each of the fastener-engaging members 62 defines a slot 621 that extends along the length of the armrest 61.

The position-adjusting fastener 63 includes an inner fastener 631 and an outer fastener 632. In the preferred embodiment, the inner fastener 631 is in the form of a bolt with an externally threaded section 634 and a head 633. The head 633 is sized so that the inner fastener 631 is unable to pass through the slots 621 of the fastener-engaging members 62. Furthermore, in the preferred embodiment, the outer fastener 632 is in the form of a nut that is internally threaded to engage the externally threaded section 634 of the inner fastener 631. The outer fastener 632 is sized and shaped to allow for easy manipulation by a user and to abut against the outer fastener-engaging member 62.

Each of the upper ends of the forward legs 31 of the front leg member 3 is inserted between a pair of the fastener-engaging members 62 of the armrest assemblies 6. A hole is formed in each of the forward legs 31 to allow the inner fastener 631 to pass therethrough, thereby connecting the forward legs 31 to the armrests 61 of the armrest assemblies 6.

The legrest frame 8 includes a legrest frame body 81 and legrest clasps 82. In the preferred embodiment, the legrest frame body 81 is substantially U-shaped. Further, in the preferred embodiment, the legrest clasps 82 are substantially U-shaped, are fixed to the legrest frame body 81 at a location below the armrest assemblies 6, and are substantially aligned along the horizontal with the backrest clasps 52 of the backrest frame 5 when the collapsible chair is in the sitting upright position shown in FIGS. 1 and 3. The ends of the legrest clasps 82 are pivotally connected to the seat supports 7.

The operation of the collapsible chair structured as described above will now be explained with reference to FIGS. 4, 5, and 6.

Figure 4:
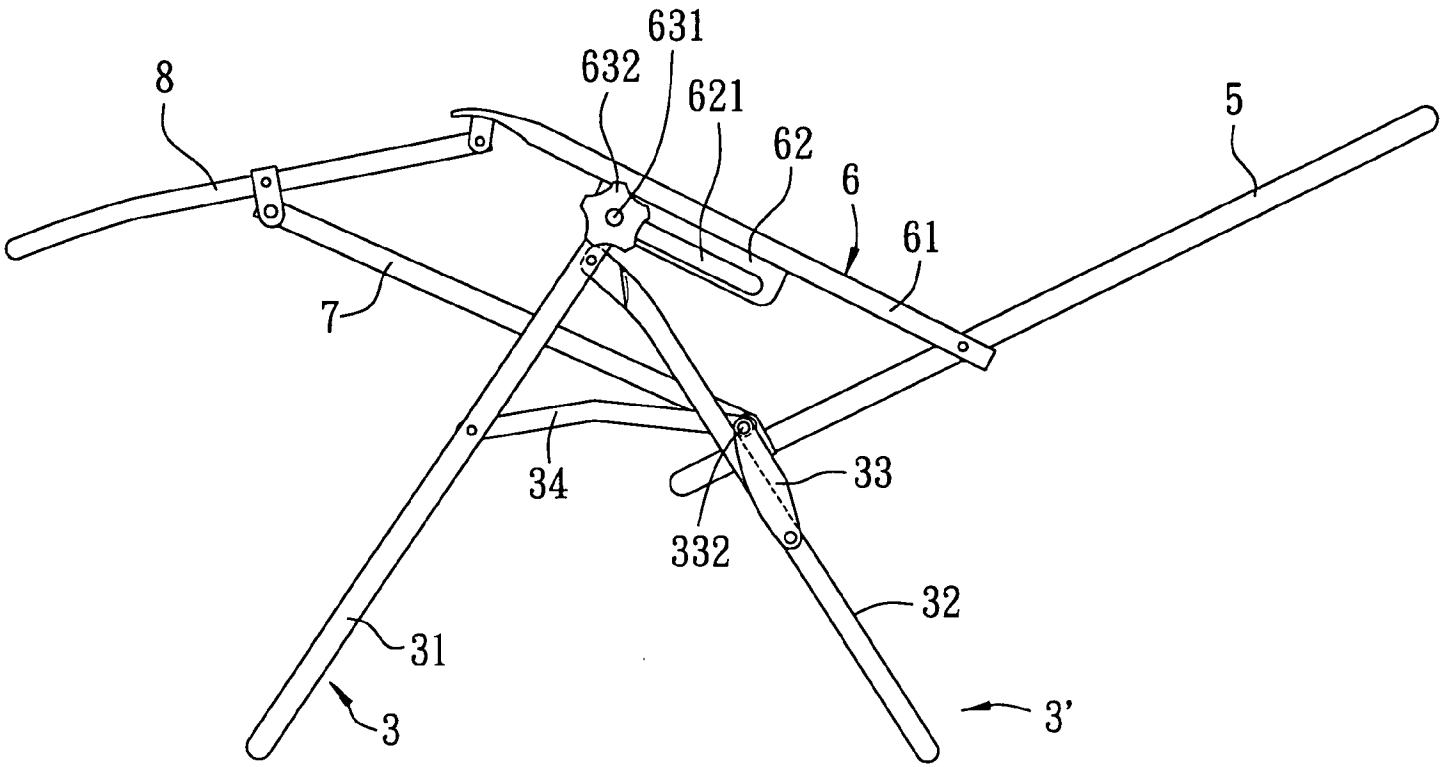
FIG. 4 is another schematic view of the preferred embodiment, in which the collapsible chair is shown in a reclining position.

Referring first to FIG. 4, assuming that materials or a combination of materials (e.g., fabric secured using a cord) are provided on the backrest frame 5, the seat supports 7, and the legrest frame 8 to allow a user to be comfortably seated in the collapsible chair, the user reclines the collapsible chair by loosening the outer fasteners 632 of the position adjusting fasteners 63 and leaning back on the backrest frame 5. When a desired reclining position is obtained, the user tightens the outer fasteners 632 to secure the collapsible chair in this position. The degree of recline is continuously varied in a stepless manner, and does not involve intermediate preset stages of recline between the sitting upright position shown in FIG. 1 and the extreme recline position shown in FIG. 4.

When the user leans back on the backrest frame 5, the backrest frame 5 pivots about the pivot axis 50 shown in FIG. 1 such that an upper end of the backrest frame 5 is displaced backward and somewhat downward. During the reclining operation, the degree of spread between the forward legs 31 and the rearward legs 32 remains unaltered. However, the displacement of the backrest frame 5 does vary the positioning of the armrests 61 of the armrest assemblies 6, the seat supports 7, and the legrest frame 8.

In greater detail, since the connection of the armrests 61 to the backrest frame 5 is made at a location slightly below a mid-point of the backrest frame 5, the pivoting of the backrest frame 5 results in lowering the location of the pivot axis 50, thereby resulting in the lowering of the rear ends of the armrests 61. The armrests 61 displace along the slots 621 of the coupling devices 6' to result in displacing a distal end of the legrest frame 8 in an upward and outward manner, and in upward tilting of the seat supports 7.

Figure 5:
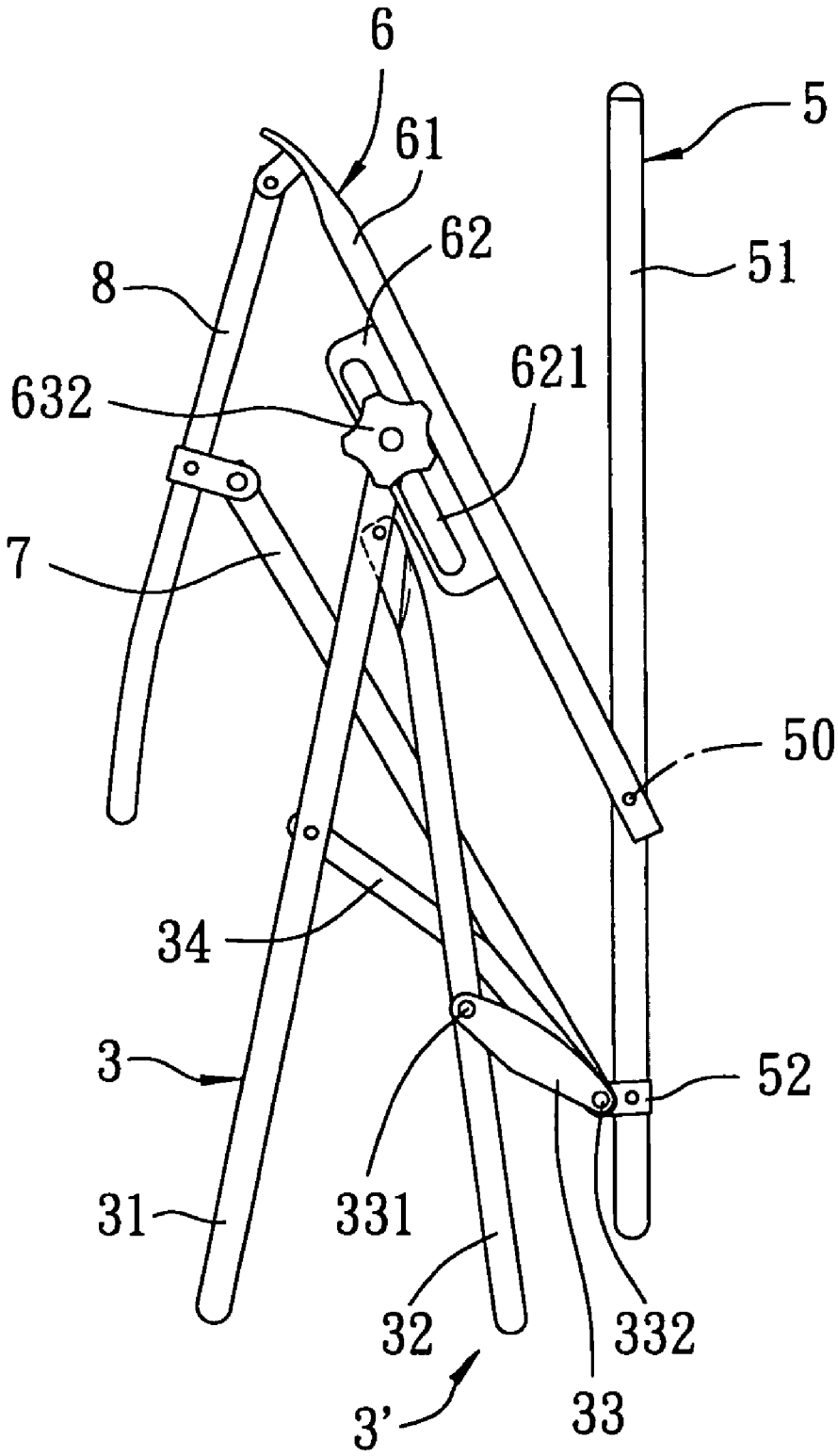
FIG. 5 is a schematic view to illustrate a partly folded state of the preferred embodiment.
Figure 6:
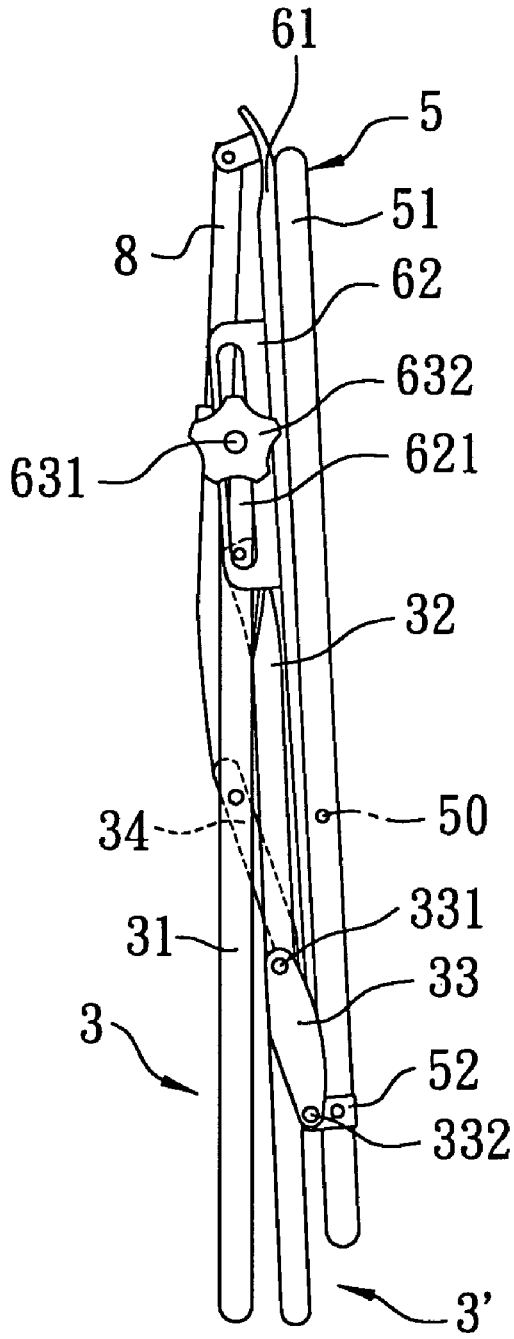
FIG. 6 is a schematic view to illustrate a completely folded state of the preferred embodiment.

Referring to FIGS. 5 and 6, the collapsible chair is folded for transport or storage while in an unseated state, by loosening the outer fasteners 632 and pulling the armrests 61 toward the backrest frame 5. In view of the ability of all the elements to pivot relative to at least one of the other elements as described above, all of the parts of the collapsible chair move in the direction of the backrest frame 5, as shown in FIG. 5.

In particular, the armrests 61 of the armrest assemblies 6 pivot about their connection to the backrest frame 5 such that the front ends of the armrests 61 move upwardly and approach the backrest frame body 51 of the backrest frame 5. As a result, the legrest frame 8 is moved toward the backrest frame 5.

In addition, by virtue of the pivotable connection between the seat supports 7 and the legrest frame 8, and between the seat supports 7 and the backrest frame body 51 of the backrest frame 5, the front portions of the seat supports 7 move upwardly and toward the backrest frame 5. Finally, due to the pivotable connection between the forward legs 31 and the rearward legs 32, and that between the forward legs 31 and the armrest assemblies 6 (when the outer fasteners 632 are loosened), the forward legs 31 and the rearward legs 32 move toward each other and toward the backrest frame 5.

After reaching approximately the position shown in FIG. 5, the user continues to force the armrests 61 of the armrest assemblies 6 toward the backrest frame 5. As a result, the elements of the collapsible chair continue in their movements as described above until the collapsible chair becomes completely folded as shown in FIG. 6.

During the folding operation shown in FIG. 5, the second ends 332 of the connectors 33 move away from the rearward legs 32 of the rear leg member 3', then eventually downward such that the second ends 332 of the connectors 33 are positioned below the first ends 331 thereof and adjacent to the rearward legs 32. This aids in the folding of the collapsible chair by virtue of the pivotable connection of the second ends 332 of the connectors 33 to the extension limiters 34, the seat supports 7, and the backrests clasps 52 of the backrest frame 5.

The chair is set up back into the sitting upright position or in a reclining position by performing the above operations in reverse.

In the collapsible chair of the present invention, the reclining angle of the back support frame and the height of the leg support frame may be simultaneously adjusted by simple operation of the coupling device. The adjustment is made continuously through a range of reclining positions, and not by using a limited number of pre-established reclining stages.

Furthermore, the folding of the collapsible chair is also performed through a simple process involving loosening the position adjusting fasteners and minimally manipulating the chair so that it is folded.

The overall securing mechanism of the present invention is simple and very secure, and is structured such that only minimal wearing occurs.

While the present invention has been described in connection with what is considered the most practical and preferred embodiment, it is understood that this invention is not limited to the disclosed embodiments but is intended to cover various arrangements included within the spirit and scope of the broadest interpretation so as to encompass all such modifications and equivalent arrangements.

I claim:

1. A collapsible chair comprising:

a leg frame unit having an upper frame end, and including a front leg member having an upper end portion, a rear leg member having an upper end portion connected pivotally to said upper end portion of said front leg member, a connector having a first end connected pivotally to said rear leg member, and a second end, and an extension limiter having a rear portion connected pivotally to said second end of said connector, and a front portion connected pivotally to said front leg member;

a backrest frame having a lower back portion connected pivotally to said second end of said connector;

a pair of armrests, each of which has a rear end connected pivotally to said backrest frame, a front end opposite to said rear end in a front-to-rear direction, and an intermediate section between said rear and front ends;

at least one coupling device for coupling said upper frame end of said leg frame unit to said intermediate section of one of said armrests, said coupling device including a fastener-engaging member secured to said intermediate section of said one of said armrests and formed with a slot that extends in the front-to-rear direction, an inner fastener having a head, and an externally threaded section that extends from said head and through said upper frame end of said leg frame unit and said slot, and an outer fastener engaging threadedly said externally threaded section, said coupling device arresting movement of said upper frame end of said leg frame assembly relative to said slot when said outer fastener is tightened on said externally threaded section of said inner fastener;

a seat member having a rear portion connected pivotally to said second end of said connector, and a front portion; and a legrest frame having an upper portion connected pivotally to said front ends of said armrests, said legrest frame being further connected pivotally to said front portion of said seat member.

* * * * *